US009208939B2

(12) United States Patent
Weber et al.

(10) Patent No.: US 9,208,939 B2
(45) Date of Patent: Dec. 8, 2015

(54) TRANSFORMER WINDING WITH COOLING CHANNEL

(71) Applicant: ABB Technology AG, Zürich (CH)

(72) Inventors: Benjamin Weber, Winterberg (DE); Bhavesh Patel, Brilon (DE); Burak Esenlik, Paderborn (DE); Frank Cornelius, Olsberg (DE); Marcos Bockholt, Paderborn (DE); Jens Tepper, Brilon (DE)

(73) Assignee: ABB TECHNOLOGY AG, Zürich (CH)

( * ) Notice: Subject to any disclaimer, the term of this patent is extended or adjusted under 35 U.S.C. 154(b) by 0 days.

(21) Appl. No.: 13/934,750

(22) Filed: Jul. 3, 2013

(65) Prior Publication Data

US 2013/0293329 A1 Nov. 7, 2013

Related U.S. Application Data

(63) Continuation of application No. PCT/EP2011/005969, filed on Nov. 29, 2011.

(30) Foreign Application Priority Data

Jan. 4, 2011 (EP) ..... 11000018

(51) Int. Cl.
*H01F 27/08* (2006.01)
*H01F 27/30* (2006.01)
(Continued)

(52) U.S. Cl.
CPC ..... *H01F 27/2876* (2013.01); *H01F 27/085* (2013.01); *H01F 27/322* (2013.01); *H01F 2027/328* (2013.01)

(58) Field of Classification Search
CPC ..... H01F 6/04; H01F 27/08; H01F 27/085; H01F 27/20; H01F 27/2876; H01F 27/322; H01F 2027/328
USPC ..... 336/5, 55, 179, 182, 206, 184, 185, 336/197, 60
See application file for complete search history.

(56) References Cited

U.S. PATENT DOCUMENTS 2,710,947 A * 6/1955 Gaston ..... 336/60
2,904,760 A * 9/1959 Johnston ..... 336/60
(Continued)

FOREIGN PATENT DOCUMENTS

FR 1 278 093 A 12/1961

OTHER PUBLICATIONS

International Search Report (PCT/ISA/210) issued on Mar. 9, 2012, by the European Patent Office as the International Searching Authority for International Application No. PCT/EP2011/005969.

*Primary Examiner* — Mangtin Lian
(74) *Attorney, Agent, or Firm* — Buchanan Ingersoll & Rooney PC

(57) ABSTRACT

At least two winding modules nested hollow-cylindrically one inside the other and extending around a common winding axis, wherein said winding modules are spaced radially apart from one another within at least one hollow-cylindrical cooling channel arranged therebetween by means of insulation strips, wherein the insulation strips have a cross-sectional form which avoid a surface profile radially with respect to the winding axis, the insulation strips including one of a fiber-reinforced epoxy, polyester resin, or from an unreinforced thermoplastic material.

5 Claims, 2 Drawing Sheets

(51) Int. Cl.
*H01F 27/28* (2006.01)
*H01F 27/32* (2006.01)

(56) References Cited

U.S. PATENT DOCUMENTS 3,195,084 A * 7/1965 Bock ..... 336/60
3,237,136 A * 2/1966 Ford ..... 336/205
3,302,149 A * 1/1967 Forsha ..... 336/58
4,172,244 A * 10/1979 Zeis ..... 336/73
4,447,796 A * 5/1984 Heinrichs ..... 336/60
4,663,604 A * 5/1987 VanSchaick et al. ..... 336/96
5,621,372 A * 4/1997 Purohit ..... 336/60
7,788,794 B2 * 9/2010 Sarver et al. ..... 29/602.1
2007/0069843 A1 * 3/2007 Arik et al. ..... 336/55
2009/0212897 A1 * 8/2009 Schaal et al. ..... 336/222

* cited by examiner

TRANSFORMER WINDING WITH COOLING CHANNEL

RELATED APPLICATION(S)

This application claims priority as a continuation application under 35 U.S.C. §120 to PCT/EP2011/005969, which was filed as an International Application on Nov. 29, 2011 designating the U.S., and which claims priority to European Application 11000018.9 filed in Europe on Jan. 4, 2011. The entire contents of these applications are hereby incorporated by reference in their entireties.

FIELD

The disclosure relates to a transformer winding having (e.g., comprising) at least two winding modules nested hollow-cylindrically one inside the other and extending around a common winding axis, wherein said winding modules are spaced radially apart from one another within at least one hollow-cylindrical cooling channel arranged therebetween by means of insulation strips.

BACKGROUND INFORMATION

It is known that power transformers, for example with a power rating of a few MVA and in a voltage range of from, for example, 5 kV to 30 kV or 110 kV, sometimes even up to 170 kV, are also formed as dry-type transformers, wherein in the last-mentioned voltage range, power ratings of 50 MVA and above are also readily possible. During operation of a transformer, lost heat is developed in the electrical windings of said transformer, and this lost heat should be dissipated to the surrounding environment. Therefore, in order to cool such a dry-type transformer, usually at least one cooling channel guided along the axial extent of the winding is developed in order to pass the lost heat out of the winding interior such as through natural air cooling.

In order to increase the cooling effect, the radially inner low-voltage winding can be divided into a plurality of hollow-cylindrical winding segments which are spaced radially apart and are electrically connected in series, and between which a likewise hollow-cylindrical cooling channel is arranged. However, a cooling channel is usually also provided between the low-voltage winding and the high-voltage winding. A radial distance between adjacent winding modules, which ultimately results in a cooling channel, is in this case provided via electrically insulating rectangular profiles or else via so-called "dog-bone" strips.

However, one disadvantage known arrangements can involve the cooling channel, which depending on the electrical boundary conditions, sometimes should be designed to be wider than a normally accepted width based on the cooling cross section because, if specified, a minimum electrical insulation effect can be called for between adjacent winding modules, which is achieved by correspondingly thicker insulation strips. As a result, the transformer winding can become unnecessarily large and the power density of a transformer is correspondingly reduced.

SUMMARY

An exemplary transformer winding is disclosed comprising: at least two winding modules nested hollow-cylindrically one inside the other and extending around a common winding axis, wherein said winding modules are spaced radially apart from one another within at least one hollow-cylindrical cooling channel arranged therebetween through insulation strips, wherein the insulation strips have a cross-sectional form and a surface profile that is radial with respect to the winding axis, the insulation strips including one of a fiber-reinforced epoxy, polyester resin, or from an unreinforced thermoplastic material.

BRIEF DESCRIPTION OF THE DRAWINGS

The disclosure, further embodiments and further advantages will be described in more detail with reference to the exemplary embodiments illustrated in the drawings, in which.

DETAILED DESCRIPTION

Figure 1:
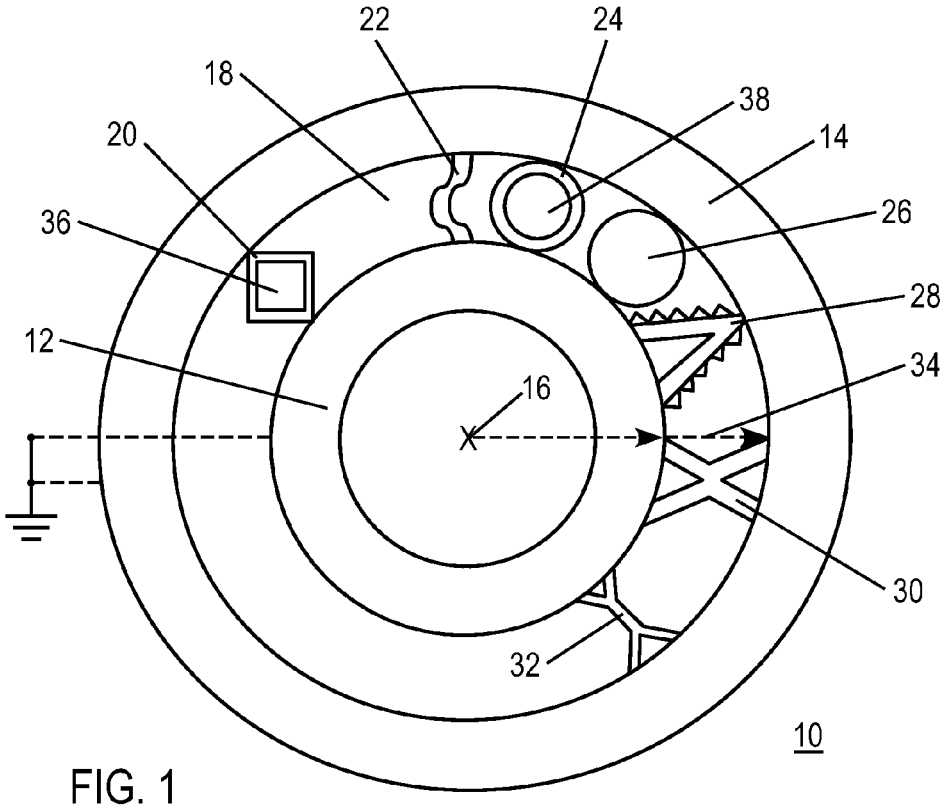
FIG. 1 shows a perspective view of a section through a first transformer winding according to an exemplary embodiment of the present disclosure.

Against the background of these known arrangements exemplary embodiments of the present disclosure provide a transformer winding with a cooling channel which has improved insulation capacity.

The disclosed exemplary embodiments include a transformer winding of the type mentioned already discussed. This transformer winding can include insulation strips having a cross-sectional form which predominantly avoids a surface profile radially with respect to the winding axis.

The insulation capacity of an insulator is firstly determined by the material used therefor and secondly by its outer face, along which surface discharges can occur insofar as the voltage stress is correspondingly high, for example a few 100 V/cm and higher. Surface discharges are promoted when the electrical lines of force are tangential to the surface of an insulator, with the result that the voltage stress is at its greatest along the surface. Within a hollow-cylindrical cooling channel, the lines of force or else equipotential lines, depending on the specific design of the transformer, run approximately concentrically around a mid-axis of the cooling channel, which mid-axis also corresponds to the winding axis of the winding. Therefore, when using the known rectangular profiles or else the double-T-like "dog-bone" profiled strips as insulation strips within a cooling channel, the voltage stress is at its maximum along the outer faces of said profiled strips, because said outer faces run to a very high extent radially with respect to the winding axis. The reasoning behind such an arrangement consists in that the mechanical forces for spacing apart the adjacent winding segments are likewise aligned radially. The cross-sectional form of the insulation strips according to known implementations is therefore dependent on a mechanically suitable form which is as simple as possible. Exemplary embodiments of the present disclosure provide the insulation capacity of the insulation strips, by virtue of correspondingly having the cross section or outer faces thereof, in such a way that the voltage stress of said insulation strips is reduced, wherein secondly, nevertheless, a correspondingly high mechanical stability is ensured.

According to an exemplary embodiment of the present disclosure the insulation strips can be manufactured from a fiber-reinforced epoxy or polyester resin. This firstly has a high insulation capacity. Secondly, it is possible by virtue of the fiber reinforcement to realize a wide range of variants of cross-sectional forms which are nevertheless characterized by high mechanical stability. The form of such an insulation strip could be produced, for example, by milling or by pultrusion processes. A further precondition for the use in a transformer winding, namely a temperature resistance up to, for example, 150° C. and above, as can quite easily be specified in the case of dry-type transformers, is likewise advantageously provided.

In another exemplary embodiment, further insulation materials, for example unreinforced thermoplastic materials such as polyamides can be used. Only the polyamides which also have a correspondingly high stability at at least 130° C. are of course suitable. An advantage of polyamides is found in the fact that they can be readily deformable.

According to another exemplary embodiment disclosed herein, the at least one cooling channel to have a radially inner wall and a radially outer wall, which are then spaced apart by the insulation strips. The walls can easily also be segmented. Therefore, simplified installation of then shell-like cooling channels is advantageously made possible, as a result of which, in addition, protection of the adjoining winding faces is enabled.

According to yet another exemplary embodiment, the insulation strips have a rhombic or a round cross section. These are standard geometrical forms which are simple to manufacture and which are nevertheless suitable for improved insulation. In order to save weight and material, it can prove advantageous if the insulation strips are formed with an inner cavity.

In exemplary embodiments of the present disclosure the insulation strips can have an S-shaped, X-shaped, V-shaped or Y-shaped cross section. In this case, radially running outer face components are advantageously largely avoided, with the result that improved insulation capacity can be achieved. In addition, the X-shaped, V-shaped and Y-shaped variants have proven to be stable owing to their support-like design. Also, with respect to torsional stress between the adjacent and spaced-apart winding modules, the X form and V form can be advantageous due to their angled support regions.

In other exemplary embodiments, insulation strips which have a cross section with saw-tooth-like outer edges can be suitable for achieving improved insulation capacity. This can mean both an additionally fluted surface form of an insulation strip already in accordance with the disclosure and, for example, a ribbed surface or outer face form of an insulation strip with a known rectangular cross section.

In accordance with another exemplary embodiment, the insulation strips have a flattened form at their radially inner and/or radially outer end, which flattened form is ideally configured such that an insulation strip arranged in a cooling channel adjoins the regions to be supported at the flattened regions with as planar a fit as possible. This can be either a winding module itself or else a separate wall of a cooling channel. In an exemplary embodiment disclosed herein, the flattened form is in the form of a spherical cylinder, e.g., matched to the cylinder form of the adjoining winding modules. As a result, electrical discharges at the contact regions are advantageously avoided. Depending on the configuration of the transformer winding, the term "cylinder form" or else "hollow-cylindrical" should not be understood strictly or geometrically to be limited to a round base, but this should also mean a basic form approximating that of a rectangle with round edge regions. This arrangement can provide a high degree of utilization of a volume available in a transformer core by transformer windings possible.

According to another exemplary embodiment, the winding modules can be galvanically connected to one another. A cooling channel with exemplary spacing both between galvanically isolated high-voltage windings and low-voltage windings and between winding modules or else winding segments of a divided transformer winding as disclosed herein is thus possible. This arrangement can be expedient in the case of dry-type transformers with a relatively high power, in which case a correspondingly large amount of waste heat should be dissipated out of the interior during operation, which is correspondingly simplified by a plurality of cooling channels.

The advantages of a transformer winding according to the exemplary embodiments disclosed herein also extend to a transformer having (e.g., comprising) at least one transformer core and one transformer winding. This transformer winding is smaller than a known transformer winding and thus advantageously enables a smaller physical volume for a transformer according to disclosed exemplary embodiments provided herein.

FIG. 1 shows a perspective view of a section through a first transformer winding according to an exemplary embodiment of the present disclosure. As shown in FIG. 1, a first hollow-cylindrical winding module 12 and a second hollow-cylindrical winding module 14 are arranged concentrically around a winding axis, wherein a likewise hollow-cylindrical cooling channel 18 is formed between said winding modules. The two winding modules 12, 14 can have a strip conductor, for example, wherein a winding layer is precisely as wide as the strip conductor. This arrangement can be expedient in the case of a low-voltage winding since in this case, owing to the high current flow during operation of the winding in comparison with the high-voltage winding, a large conductor cross section can be specified. However, in known arrangements such as in high-voltage-side windings, a conductor layer can have a large number of individual turns, as a result of which, during operation of the transformer winding, a more complex potential distribution along the cooling channel can be provided. The diameter of such a transformer winding is, for example, 0.5 m to 2.5 m, depending on the voltage level and the power rating.

Figure 4:
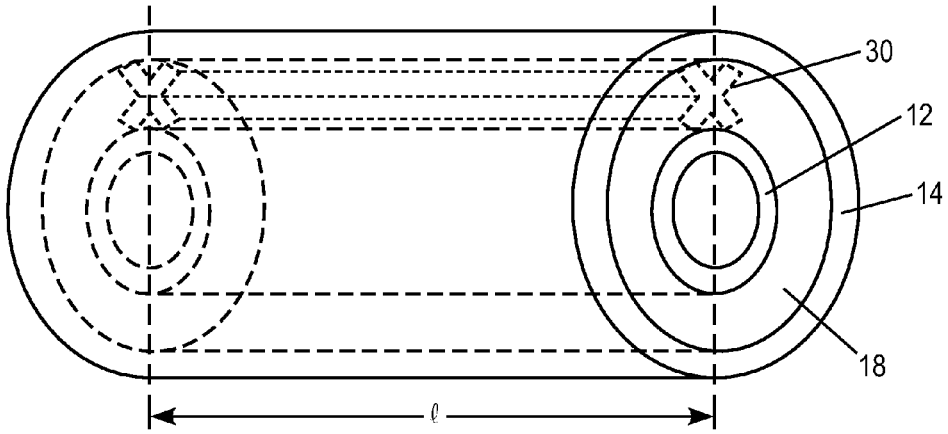
FIG. 4 shows a perspective view of an insulation strip extending along an axial length of a transformer winding.

By way of example, a plurality of insulation strips 20, 22, 24, 26, 28, 30, 32 with their cross-sectional forms are shown in the cooling channel 18, by means of which insulation strips the two winding modules 12, 14 are spaced apart from one another in a radial direction 34. The rhombic insulation strip 20 can be provided with an inner cavity 36 or 38, in the same way as the round insulation strip 24, which cavity can serve to save weight. The insulation strips 20, 22, 24, 26, 28, 30, 32 have a cross-sectional form with a surface profile radial 34 to the winding axis 16, which can avoid a surface profile radial to the winding axis. As a result, the dielectric strength of the cooling channel 18 can be increased. In a real cooling channel, a single type of insulation strip 20, 22, 24, 26, 28, 30, 32 should be provided, for example 4 insulation strips at a respective angle of 90°. FIG. 4 shows a perspective view of an insulation strip extending along an axial length of a transformer winding. An insulation strip 20, 22, 24, 26, 28, 30, 32 does not specify that it should extend over the entire axial length of a transformer winding, for example 1.5 m to 3.5 m; it can also be divided a number of times.

Figure 2:
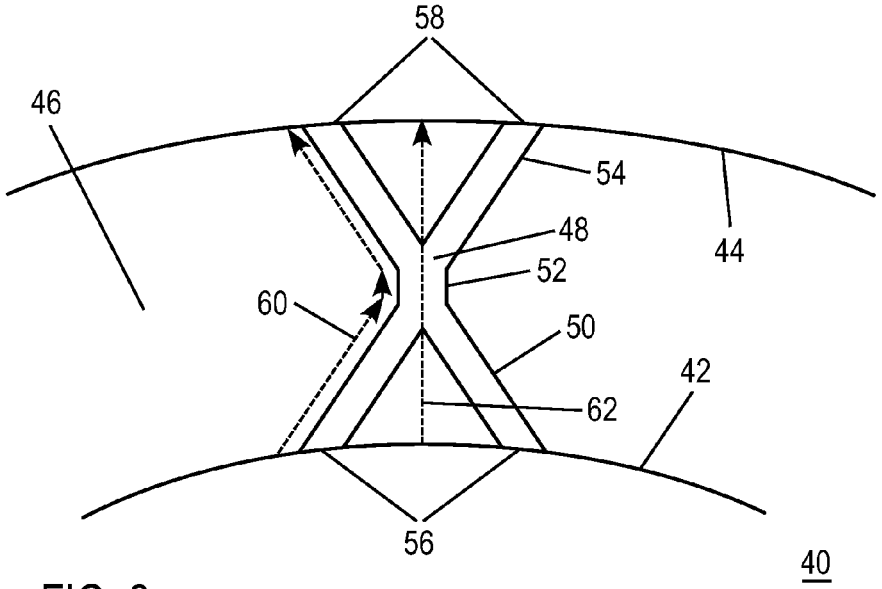
FIG. 2 shows a perspective view of a section through a second transformer winding according to an exemplary embodiment of the present disclosure.

FIG. 2 shows a perspective view of a section through a second transformer winding according to an exemplary embodiment of the present disclosure. As shown in FIG. 2, a first winding module 42 and a second winding module 44 are spaced apart by an insulation strip 48, which has approximately the form of a double Y. Contact regions 56, 58 provided radially inwards and radially outwards with respect to the adjoining winding modules 42, 44 have a flattened design, wherein they are additionally matched to the cylindrical form of the winding modules. In this way, the risk of electrical discharges in the region of the contact faces is reduced to the largest possible extent. The insulation strip 48 has a first surface region 50 running at an angle, a second radially 62 running surface region 52 and a third surface region 54 running at an angle. An increase in the dielectric strength in comparison with a rectangular profile is achieved in the regions 50, 54 running at an angle. This can also be illustrated using the extended leakage path 60 along the surface.

Figure 3:
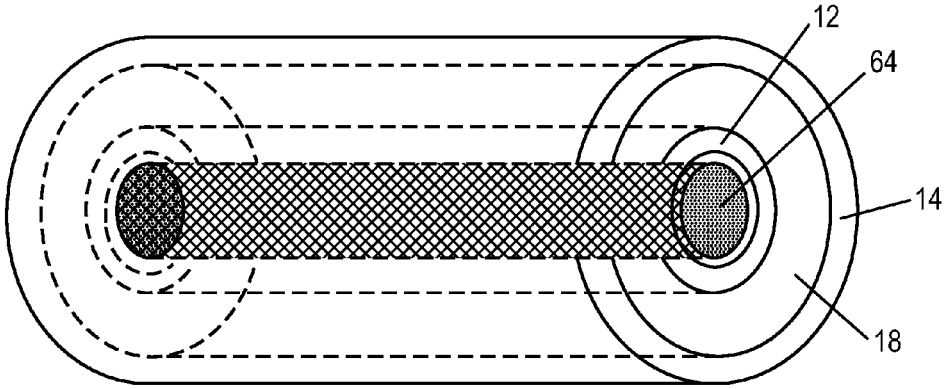
FIG. 3 shows a perspective view of a transformer having a transformer core and a transformer winding.

FIG. 3 shows a perspective view of a transformer having a transformer core and a transformer winding. As shown in FIG. 3, the transformer has a first hollow cylindrical winding module 12, a second hollow cylindrical winding module 14, and a hollow-cylindrical cooling channel 18. The first hollow-cylindrical winding module 12 is formed concentrically around a transformer core 64.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Section through an exemplary first transformer winding
12 First winding module
14 Second winding module
16 Winding axis
18 First cooling channel
20 First insulation strip
22 Second insulation strip
24 Third insulation strip
26 Fourth insulation strip
28 Fifth insulation strip
30 Sixth insulation strip
32 Seventh insulation strip
34 First radial vector
36 Inner cavity of first insulation strip
38 Inner cavity of third insulation strip
40 Section through exemplary second transformer winding
42 First winding module
44 Second winding module
46 Second cooling channel
48 Seventh insulation strip
50 First surface region running at an angle
52 Second radially running surface region
54 Third surface region running at an angle
56 Flattened form at radially inner end of insulation strip
58 Flattened form at radially outer end of insulation strip
60 Leakage path along the surface
62 Second radial vector

What is claimed is:

1. A transformer winding comprising:

at least two winding modules nested hollow-cylindrically one inside the other and extending around a common winding axis, wherein said winding modules are spaced radially apart from one another within at least one hollow-cylindrical air cooling channel arranged therebetween through insulation strips, wherein the insulation strips extend along an axial length of said winding modules and have a cross-sectional form that predominately avoids a surface profile that is radial with respect to the winding axis, the insulation strips including one of a fiber-reinforced epoxy, polyester resin, or from an unreinforced thermoplastic material, wherein the at least one cooling channel has a radially inner wall and a radially outer wall, and wherein the insulation strips have one of an X-shaped or Y-shaped cross section.

2. The transformer winding as claimed in claim 1, wherein the insulation strips have a cross section with saw-tooth-like outer edges.

3. The transformer winding as claimed in claim 1, wherein the insulation strips have a flattened form, at least one of a radially inner end, and a radially outer end.

4. The transformer winding as claimed in claim 1, wherein the winding modules are galvanically connected to one another.

5. A transformer, comprising at least one transformer core and one transformer winding as claimed in one of claim 1.

* * * * *